US006016953A

United States Patent [19]

Stacy-Ryan et al.

[11] Patent Number: 6,016,953

[45] **Date of Patent: *Jan. 25, 2000**

[54] TETRAHEDRAL TOP CARTON

[75] Inventors: Russell Stacy-Ryan, Chicago; Hichem Bouraoui, Palatine, both of Ill.; Nicholas Cook, Act, Australia

[73] Assignee: Tetra Laval Holdings & Finance, SA, Pully, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/911,448

[22] Filed: Aug. 14, 1997

[51] Int. Cl.[7] ..... B65D 43/00

[52] U.S. Cl. ..... 229/125.15; 229/113; 229/125.04

[58] Field of Search ..... 229/125.15, 112, 229/113, 5.5, 183, 125.02, 125.16, 125.17; 222/92, 105

[56] References Cited

U.S. PATENT DOCUMENTS

| | | | |
|---|---|---|---|
| 998,309 | 7/1911 | Wormer | 229/112 X |
| 1,100,448 | 6/1914 | Delz | 229/112 X |
| 2,345,646 | 4/1944 | Williamson | 229/112 X |
| 2,377,533 | 6/1945 | Waters | 229/112 X |
| 2,432,462 | 12/1947 | Waters . | |
| 2,634,815 | 6/1953 | Komeo | 229/112 X |
| 2,980,304 | 4/1961 | Sisco | 229/112 X |
| 4,891,929 | 1/1990 | Branchi . | |
| 5,001,891 | 3/1991 | Abate . | |
| 5,033,667 | 7/1991 | Abate . | |
| 5,248,054 | 9/1993 | Berggren et al. . | |
| 5,704,541 | 1/1998 | Mogard | 229/125.15 |

FOREIGN PATENT DOCUMENTS 0513495 11/1992 European Pat. Off. .

*Primary Examiner*—Gary E. Elkins
*Assistant Examiner*—Tri M. Mai
*Attorney, Agent, or Firm*—Welsh & Katz, Ltd.

[57] ABSTRACT

The present invention is tetrahedral top carton and a blank therefor. The carton has at least a nine percent material savings over a traditional gable top carton containing an equal volume of product. The carton has a tetrahedral top structure formed from four top panels intersecting and sealed adjacently. The carton may have a fitment thereon for accessing the contents. The fitment may be placed on the pinnacle of the tetrahedral top structure or on a single top panel. The carton may have outward folded fins projecting from the intersection of the top panels, or the fins may be folded inward to create a diagonal crease/edge in the intersection between adjacent top panels. The carton may also have an overfolded bottom for reverse filling on a form, fill and seal packaging machine.

2 Claims, 11 Drawing Sheets

TETRAHEDRAL TOP CARTON

BACKGROUND OF THE INVENTION

1. Field of the Invention

The present invention relates to container for flowable food packaging. Specifically, the present invention relates to tetrahedral top cartons and carton blanks therefor.

2. Description of the Related Art

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts. Gable top cartons typically begin as generally rectangular carton blanks made of a laminated paperboard or similar material. The carton blanks are provided with a number of creases to facilitate folding and forming the blank into a rectangular carton having the characteristic gabled top.

When fully folded, filled, and sealed, the gable top cartons included a gabled top structure that engages four side-panels. Traditionally, each side panel is generally perpendicular to each adjacent side panel. The panels are each divided from one another by a single vertical score line extending the entire height of the sidewall. These side panels form the characteristic hollow rectangular body of the container and define the volume of product that a carton may hold.

In accordance with accepted design approaches, the design of a traditional gable top carton to accommodate a specified volume involves adjusting the dimensions of the four sidewalls defining the rectangular body that is to contain the specified volume. Very often, these product volume requirements are specified by the packager and selected from standard volumes that have been deemed accepted in the consumer market for the product (i.e., pint, quart, half gallon, gallon, half liter, liter, etc.). When this design approach is utilized, there exists a generally established relationship between the surface area of the carton blank and the carton volume. The surface area of the carton, and particularly the area of the four sidewalls constituting the bulk of the surface area, is thus generally fixed for a given container volume.

Additional end panel extensions and end panel shapes are often employed to assist in folding and sealing the traditional gable top cartons. These added extensions and shapes result in added carton surface area per unit volume of product. One departure from the typical gable top carton is Sisco, U.S. Pat. No. 2,980,304, for a Paperboard Fluid Container which issued on Apr. 18, 1961. Sisco discloses a pyramid top carton which is adapted to substitute for glass bottles of the 1960s. The pyramid top carton of Sisco is reinforced with added layers to lessen the need for a separate nesting member. It is readily apparent that the Sisco carton does not seek to reduce the material content of a carton. The traditional approaches to gable top carton design have heretofore devoted little effort to optimizing the carton surface area per unit volume of product.

BRIEF SUMMARY OF THE INVENTION

The present invention is able to reduce the material content of a carton as compared to a similar gable top carton. The present invention is able to accomplish this by providing a tetrahedral top carton which utilizes less material than a standard gable top carton. The tetrahedral top carton has a tetrahedral top structure composed of four top panels intersecting and sealed to each adjacent top panel. The tetrahedral top carton may have a fitment disposed thereon for accessing the contents. Alternatively, a pouring spout may be integrated into one of the top panels of the tetrahedral top structure. The tetrahedral top carton of the present invention has at least a eight percent reduction in material as compared to a traditional gable top carton where four full top panels are folded in a manner to have two top panels folded on top of two other top panels and forming a top central fin.

Another aspect of the present invention is a blank for forming the tetrahedral top carton. The blank has a plurality of vertical score lines and a plurality of diagonal score lines which define the side panels and top and bottom panels, and the top and bototm fins of the carton. The carton and blank may also have bottom fins providing for an overfolded bottom structure.

It is a primary object of the present invention to provide a tetrahedral top carton.

It is a further object of the present invention to provided a carton with a material reduction over a standard gable top carton.

It is a further object of the present invention to provide a blank for a tetrahedral top carton.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of a preferred embodiment of a folded and sealed carton of the present invention;

Figure 1:
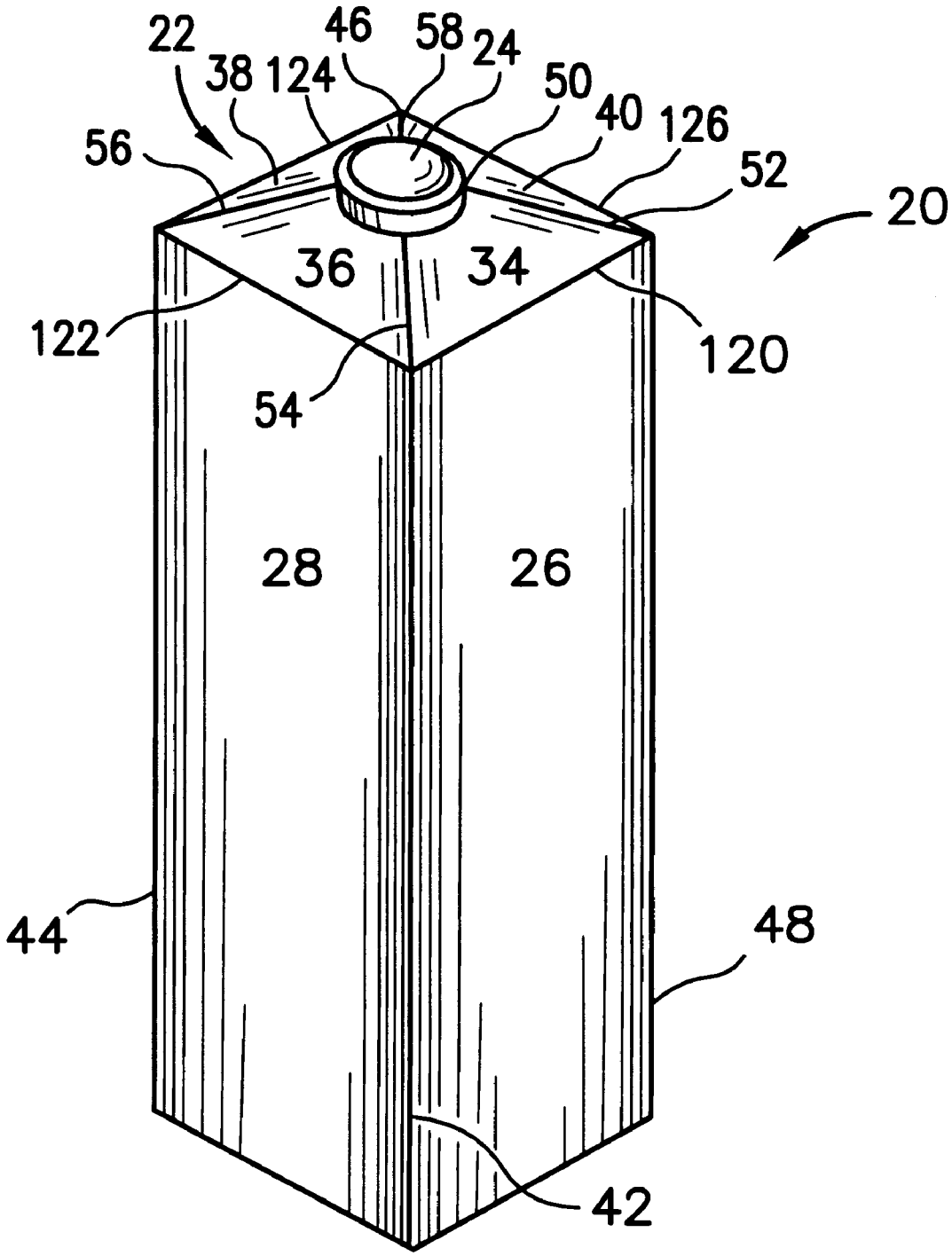
Figure 3:
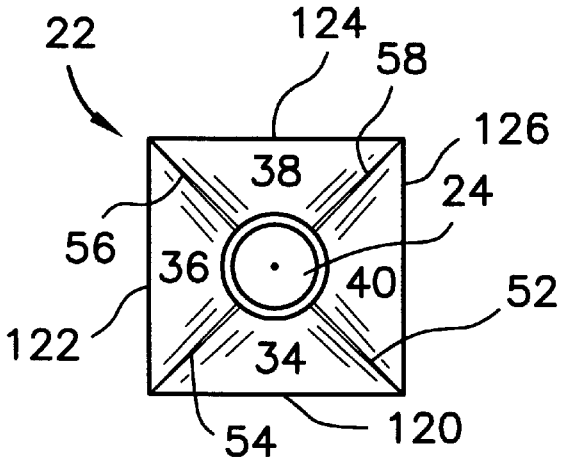
Figure 2:
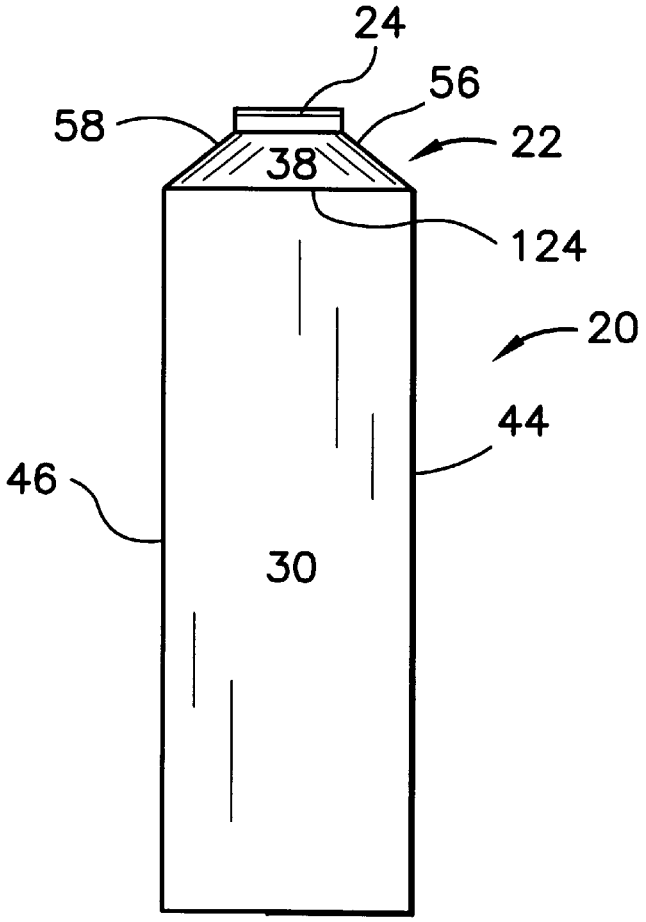
Figure 4:
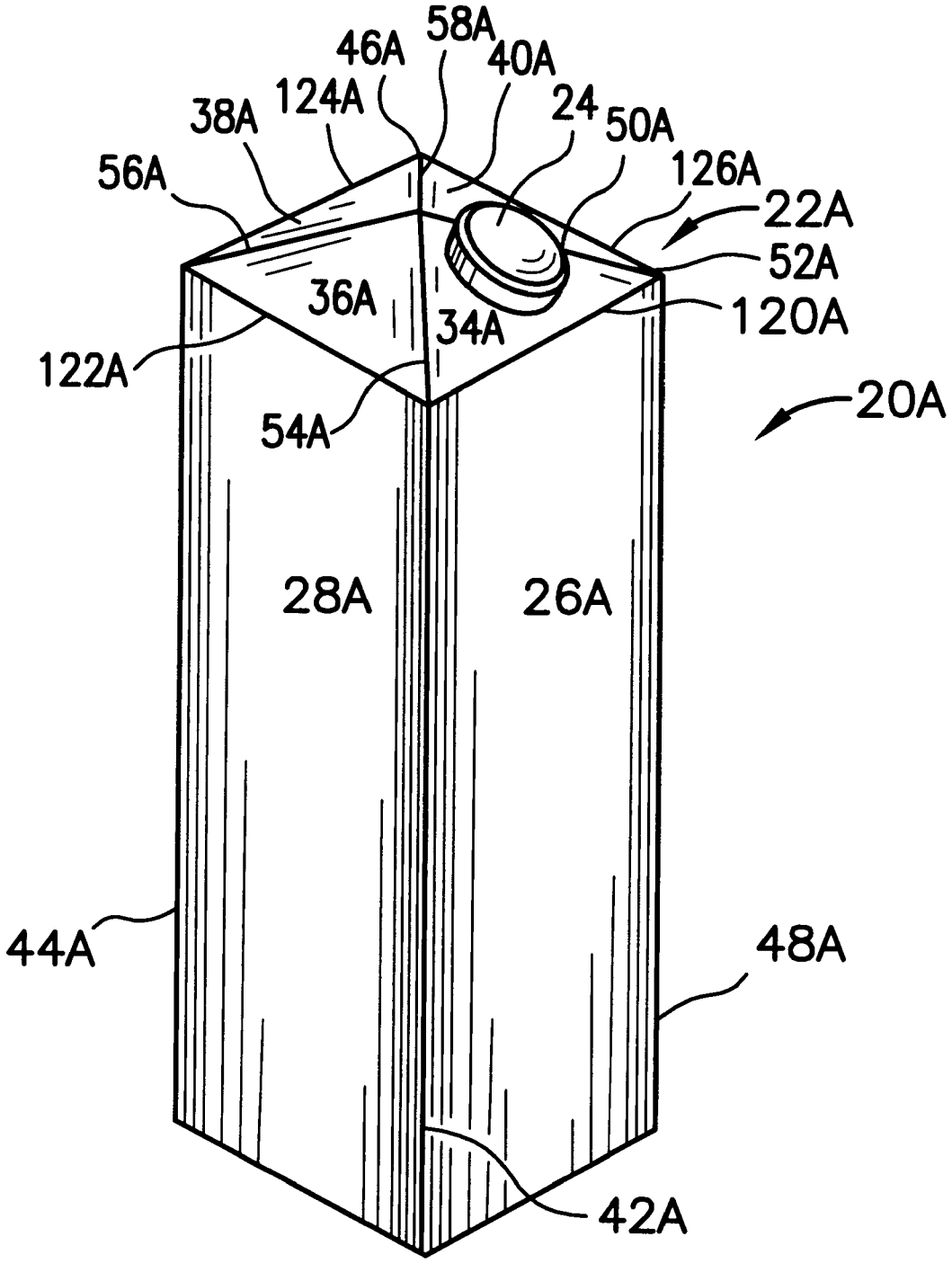
Figure 7:
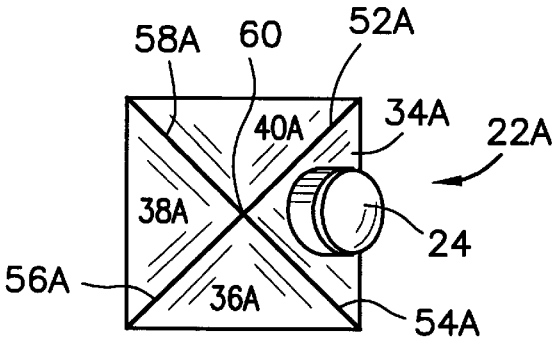
Figure 6:
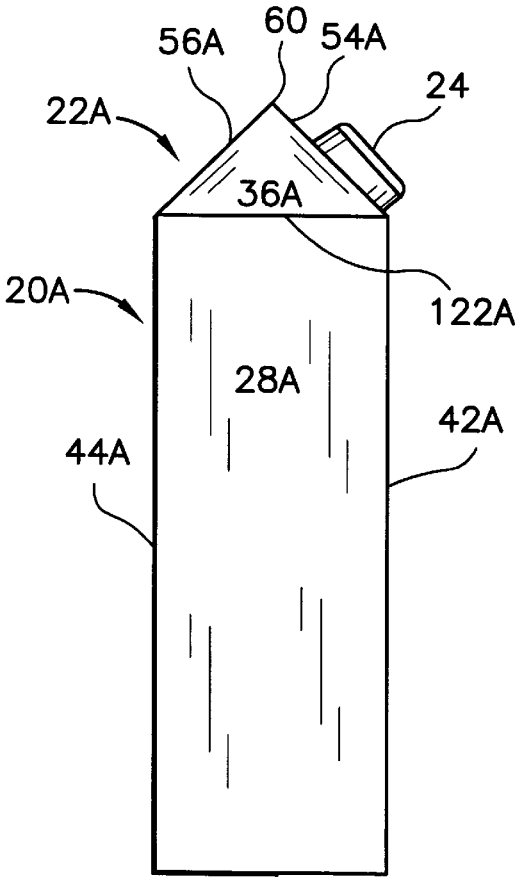
Figure 5:
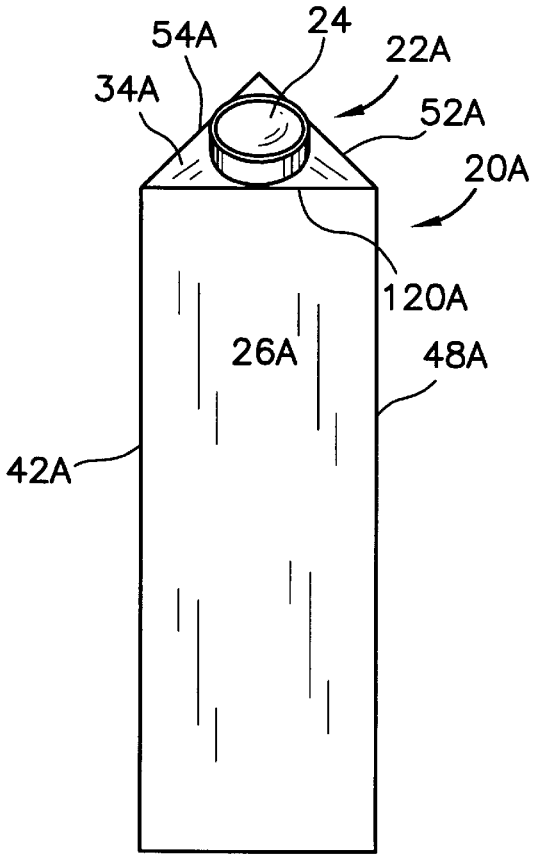
Figure 8:
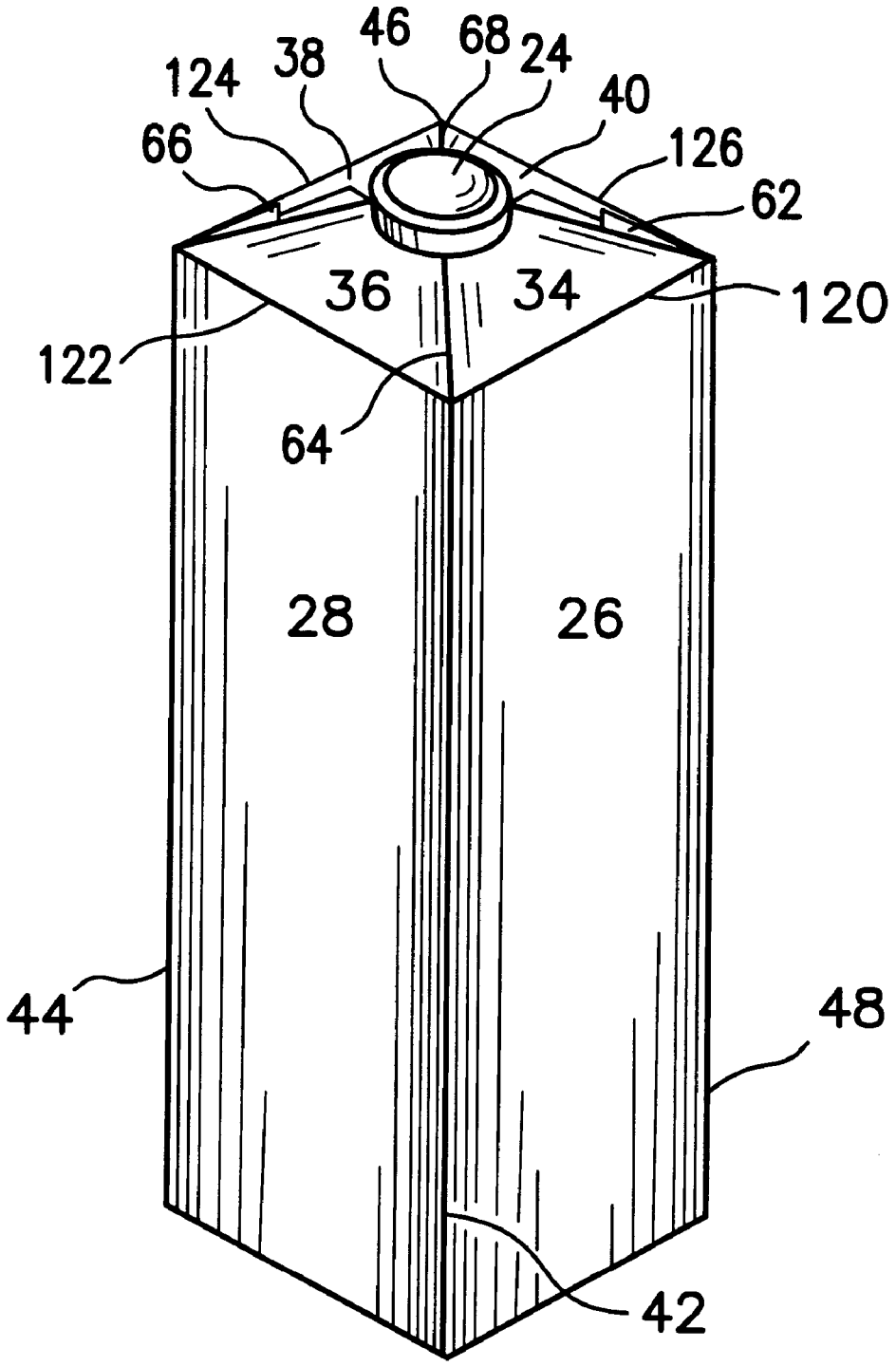
Figure 9:
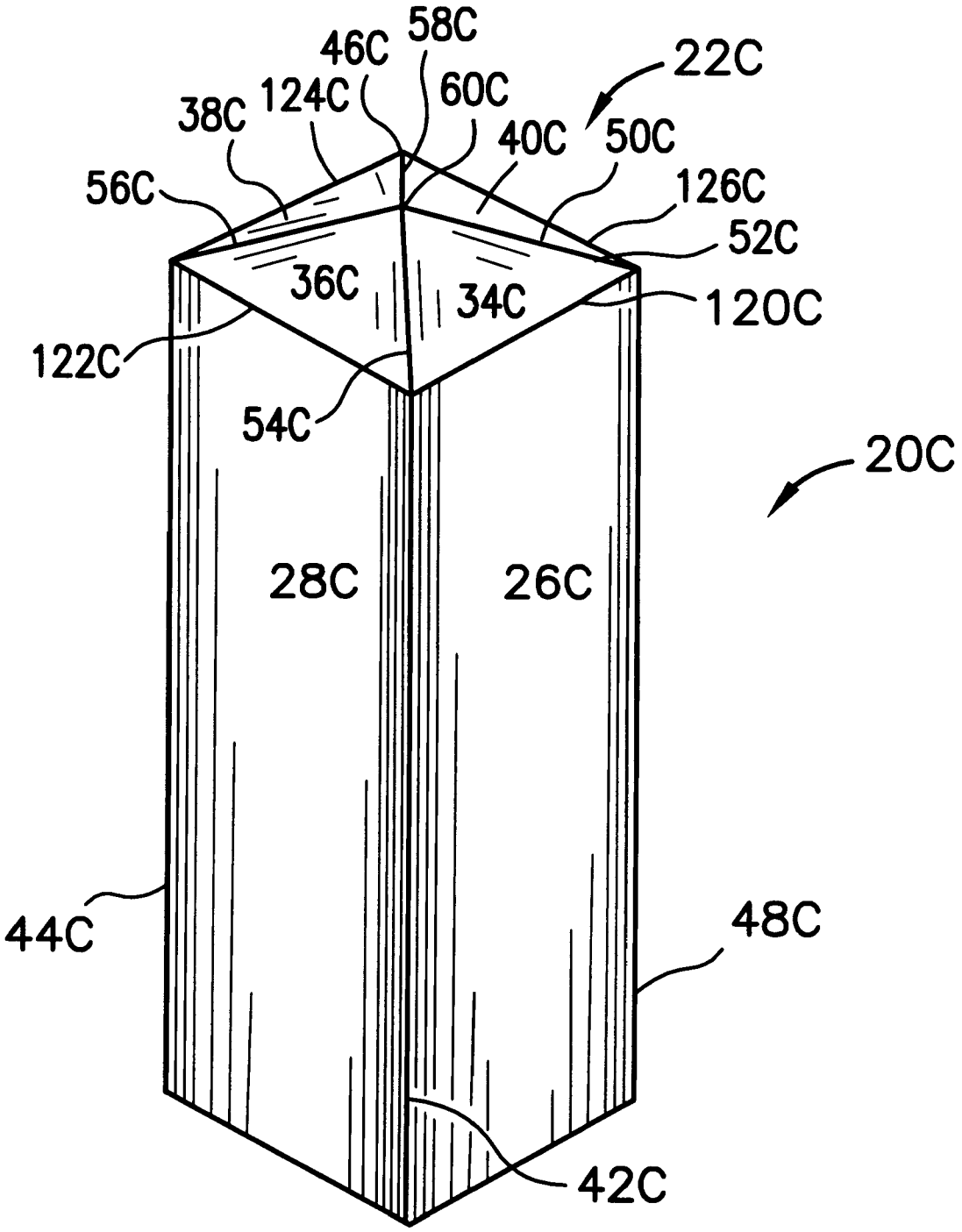
Figure 10:
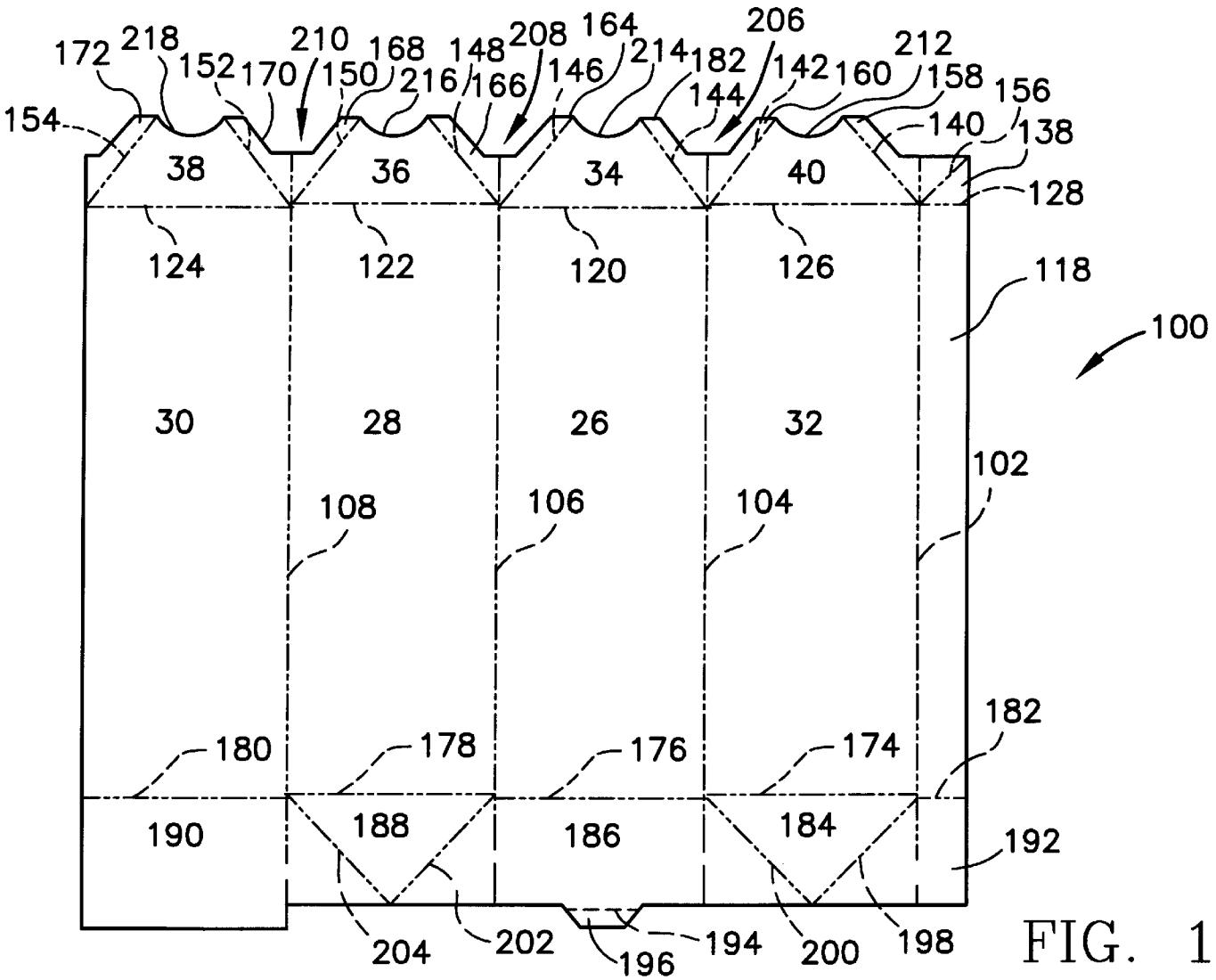
Figure 11:
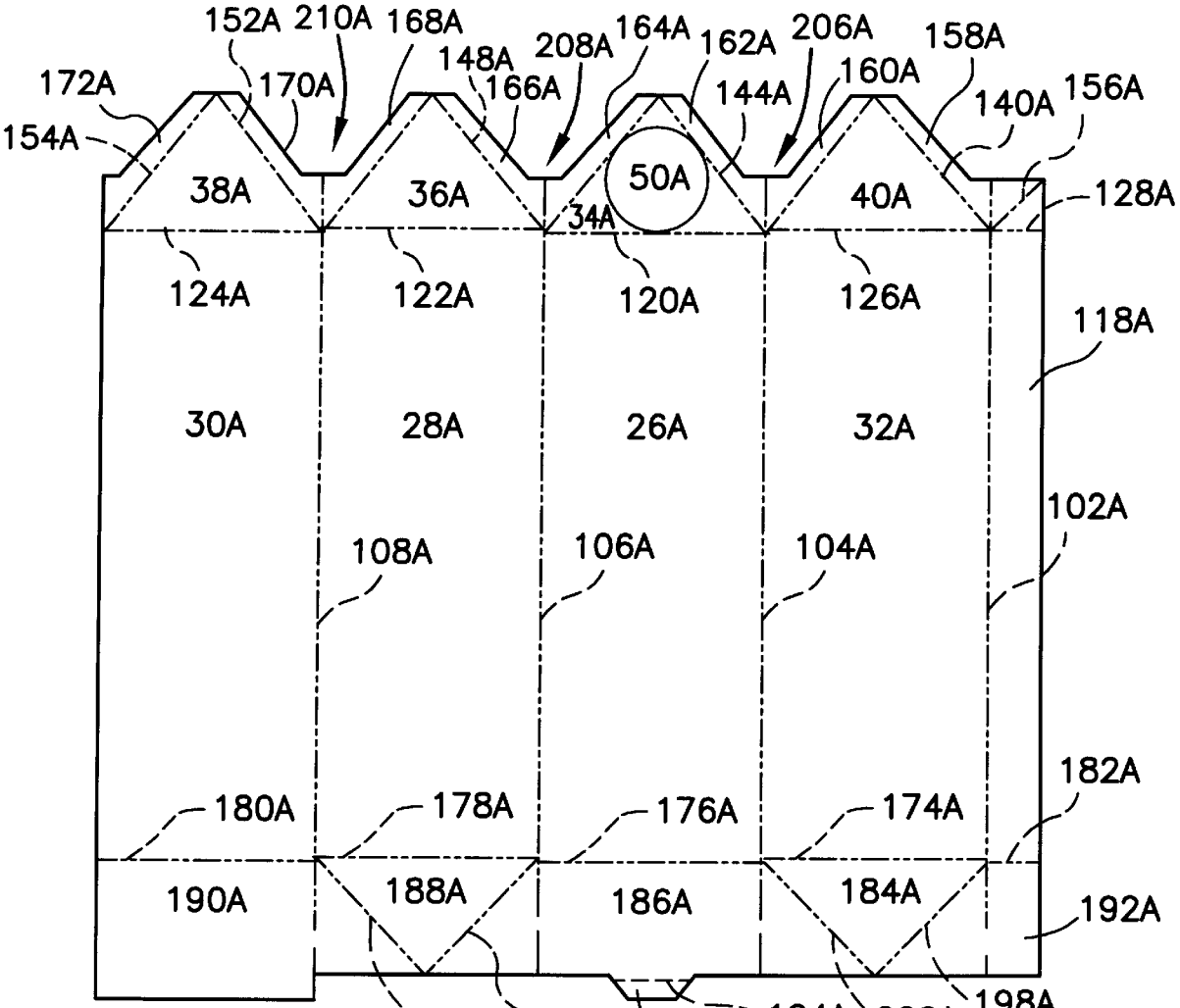
Figure 12:
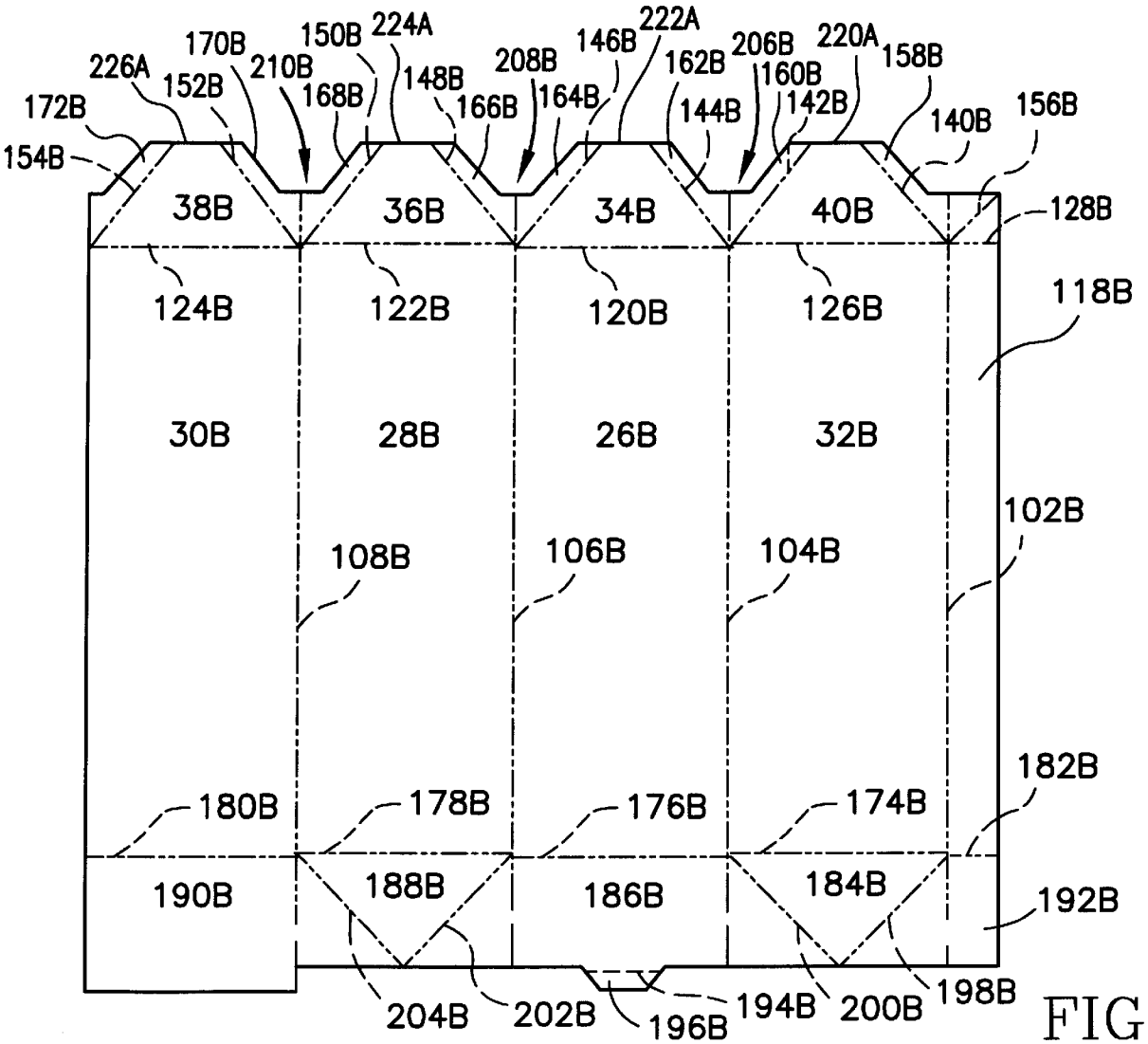
Figure 13:
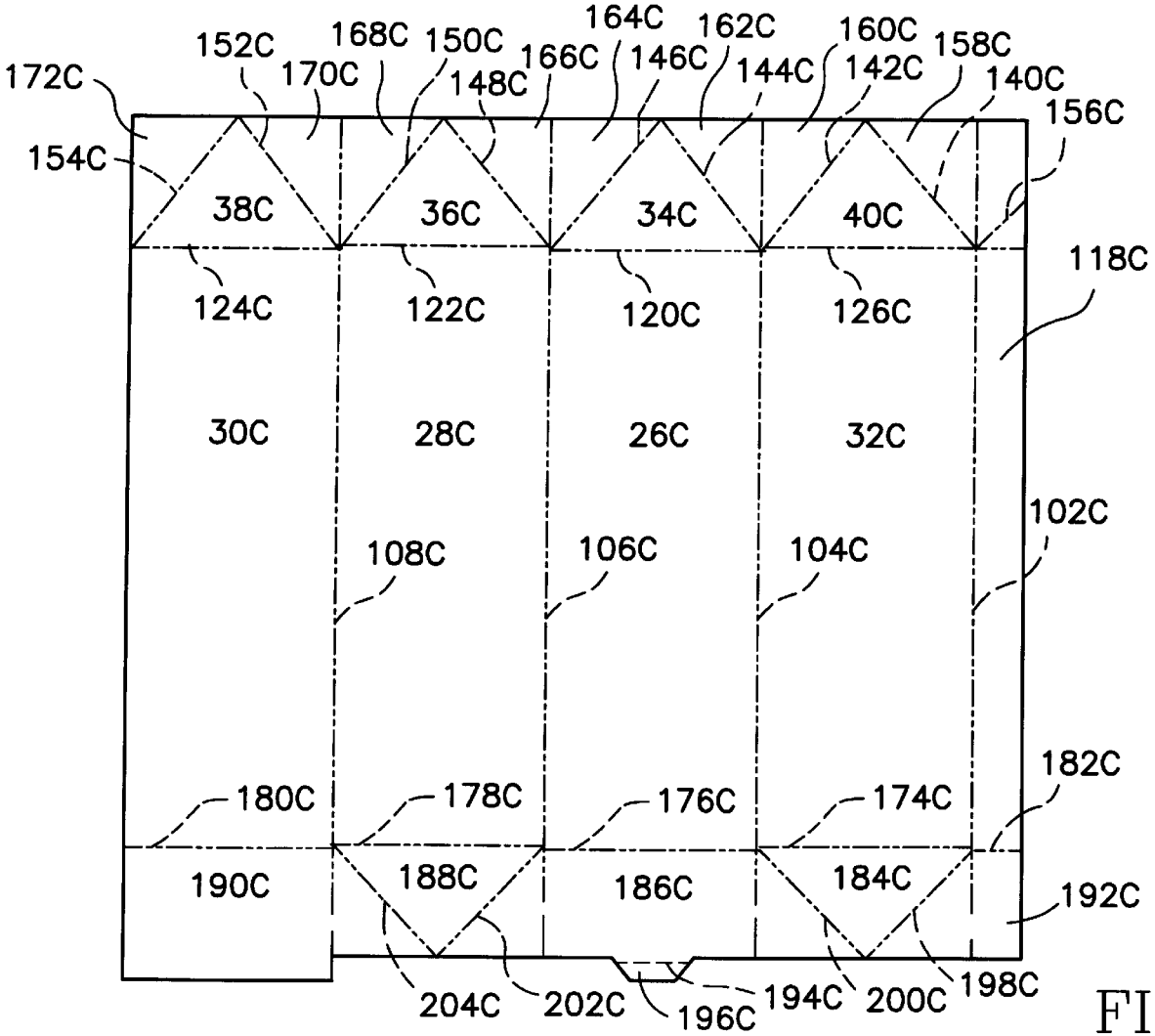
Figure 14:
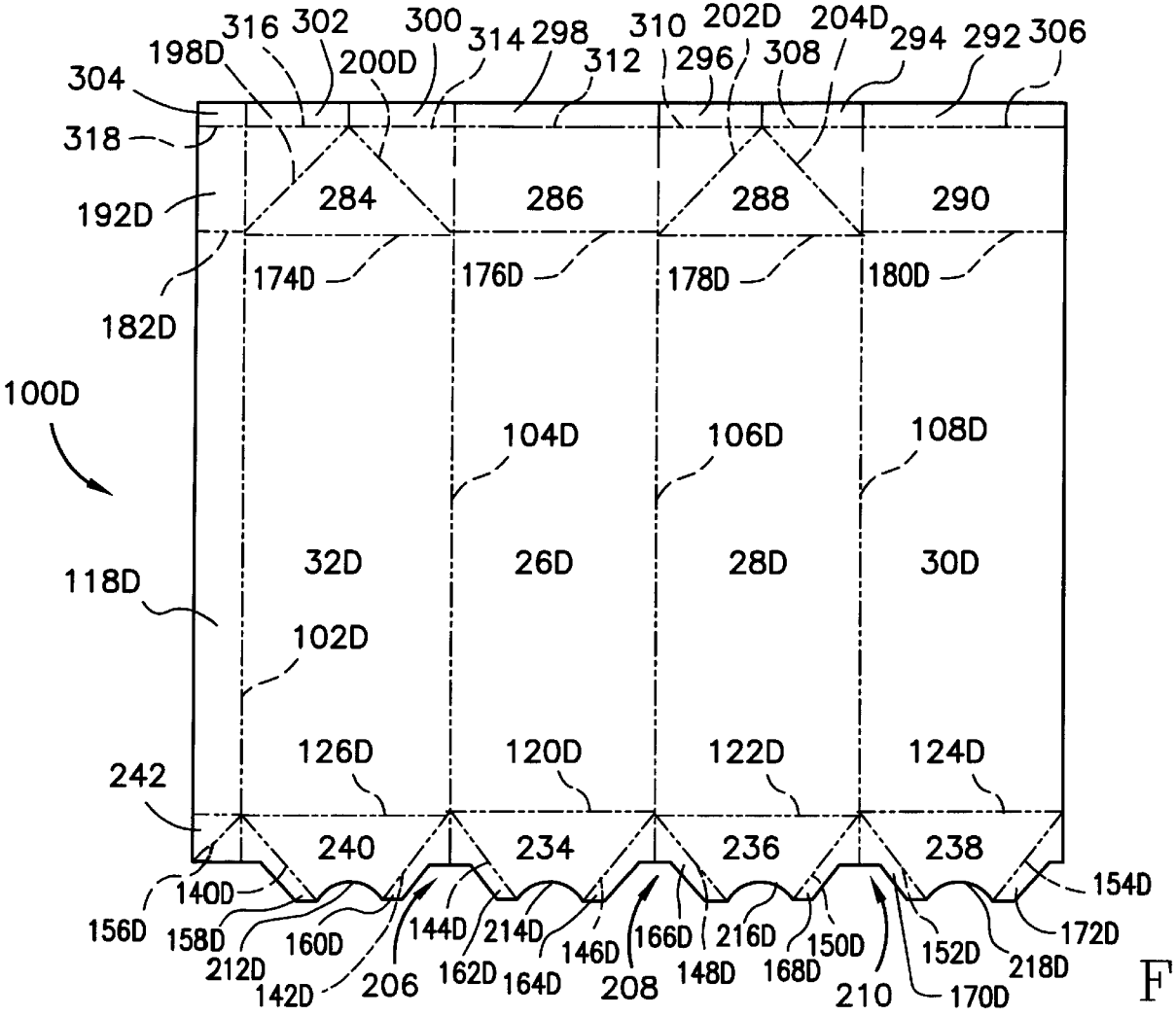

There is illustrated in FIG. 2 a front elevational view of the carton of FIG. 1;

There is illustrated in FIG. 3 a top plan view of the carton of FIG. 1;

There is illustrated in FIG. 4 a perspective view of an alternative embodiment of a folded and sealed carton of the present invention;

There is illustrated in FIG. 5 a front elevational view of the carton of FIG. 4;

There is illustrated in FIG. 6 a side elevational view of the carton of FIG. 4;

There is illustrated in FIG. 7 a top plan view of th e carton of FIG. 4;

There is illustrated in FIG. 8 a perspective view of an alternative embodiment of a folded and sealed carton of the present invention;

There is illustrated in FIG. 9 a perspective view of an alternative embodiment of a folded and sealed carton of the present invention;

There is illustrated in FIG. 10 a plan view of a preferred embodiment of a carton blank constructed in accordance with the teachings of the present invention;

There is illustrated in FIG. 11 a plan view of an altern ative embodiment of a carton blank constructed in accordance with the teachings of the present invention;

There is illustrated in FIG. 12 a plan view of an alternative embodiment of a carton blank constructed in accordance with the teachings of the present invention;

There is illustrated in FIG. 13 a plan view of an alternative embodiment of a carton blank constructed in accordance with the teachings of the present invention;

There is illustrated in FIG. 14 a plan view of an alternative embodiment of a carton blank constructed in accordance with the teachings of the present invention.

DETAILED DESCRIPTION OF THE INVENTION

The novel tetrahedral top carton of the present invention is an unique improvement over the traditional gable top cartons of the prior art. The drawings and description are in reference to a one liter carton. However, those skilled in the pertinent art will readily recognize that cartons having capacities either greater or lesser than one liter may be utilized without departing from the scope and content of the present invention. When measured for material savings against a standard gable top one liter carton, the tetrahedral top carton of the present invention has a savings of at least 8.6 percent compared for the standard gable top carton. From a diferrent perspective based on usage of material, with a standard one liter gable-top carton being set at 100 on an index, the tetrahedral top carton of the present invention has a measurement of at least 91.4 on the same index. Thus, the novel tetrahedral top carton of the present invention uses less material to package the same amount of product as a traditional gable top carton.

A preferred embodiment of the present invention is shown in FIGS. 1–3. In this preferred embodiment, the carton is generally designated 20, and includes a tetrahedral top 22 with a fitment 24 disposed in the center of the tetrahedral top 22. The fitment 24 has a reclosable cap which allows for access to the contents of the carton 20. The carton 20 is usually composed of a fiberboard material coated with polyethylene. The carton has four side panels 26–32, extending from the bottom of the carton 20 to the tetrahedral top 22. The four side panels 26–32 are generally perpendicular to each adjacent side panel with side panel 26 opposite side panel 30, and side panel 28 opposite side panel 32.

The tetrahedral top structure 22 is formed from a plurality of top panels 34–40 with the respective top fins 158–172, not shown in FIGS. 1–3, folded inward to form top diagonal edges 52–58. Each of the top diagonal edges 52–58 extend from a corresponding edge 42–48, to a cut-out 50, not shown, wherein the fitment 24 is disposed therein. The top diagonal edges 52–58 along with the respective upper horizontal score lines 120–126, define each of the four pseudo-triangle shaped top panels 34–40 which form the tetrahedral top 22.

To access the contents of the carton 20, the fitment 24, also referred to as an integrated resealable spout/cap, is provided to the consumer. Although the fitment 24 is a screw and thread type fitment, other fitments may be utilized in practicing the present invention without departing from the scope and spirit of the present invention. For example, a flip-cap may substituted for the fitment 24 shown in FIGS. 1–3. The fitment 24 may be applied to the carton 20 by any number of common methods such as ultrasonic welding, hot melt, or the like. The fitment 24 may be applied through the inside of the carton as described in copending U.S. patent application Ser. No. 08/710,619. Alternatively, the fitment 24 may be applied to the outside of the carton, either before or after filling and sealing, as described in U.S. Pat. No. 5,473,857. However, the present invention is not to be limited by application of the fitment 24, or of the necessity of a fitment 24 as described below.

There is illustrated in FIGS. 4–7 an alternative embodiment of the carton of the present invention. The carton 20A illustrated in FIGS. 4–7 is very similar to the carton 20 illustrated in FIGS. 1–3, and the similar parts have a corresponding designation except that an "A" is added to the end. For example, the side panels of FIGS. 4–7 are designated 26A–32A while the side panels of FIGS. 1–3 are designated 26–32. Thus, the description provided for FIGS. 1–3 is applicable to FIGS. 4–7 for similar designations.

The unique features of FIGS. 4–7 include the placement of the fitment 24 within a cut-out 50A, not shown, on a single top panel 34A, and the apex 60 where all four top panels 34A–40A meet and form the tetrahedral top 22A. The placement of the fitment 24 on the single top panel 34A provides an integrated angled spout component allowing for facilitated pouring of the product. Milk or juice are common products, however, other flowable food products are well within the broad intentions of the present invention.

There is illustrated in FIG. 8 yet another embodiment of the carton of the present invention. As mentioned above for FIGS. 4–7, the carton 20B illustrated in FIG. 8 is very similar to the carton 20 illustrated in FIGS. 1–3, and the similar parts have a corresponding designation except that a "B" is added to the end. The unique variation in FIG. 8 from the carton 20 of FIG. 1 is outward folded top fins 62–68. The top fins 62–68 projected upward creating an almost ornamental design to the carton 20B. However, the outward folded top fins 62–68 are a result of carton fabrication on a form, fill and seal machine. Instead of folding the fins inward to create the top diagonal edges 52–58 as shown in FIG. 1, some packaging machines may fold the fins outward to create the carton 20B of FIG. 8. The top fins 62–68 are each composed of fins from adjacent panels 34B–40B sealed together to form a single top fin 62–68 between two adjacent top panels 34B–40B. The two parts of each of the top fms 62–68 are described below in reference to the blanks illustrated in FIGS. 10–14. Fin sealing edges 70 tightly seal each of the top panels 34B–40B to each adjacent top panel 34B–40B. The fin sealing edges 70 also create a tight seal to prevent leakage of the product from the carton 20B. Similar fin sealing edges 70 are made on the cartons 20 and 20A of FIGS. 1–7, however, since the fins are folded inward, the fin sealing edges are not viewable. By forming a tight seal, the fin sealing edges 70 prevent splitting of the top fins 62–68 through moisture absorption.

There is illustrated in FIG. 9 yet another alternative embodiment of a tetrahedral top carton of the present invention. As mentioned above for FIGS. 4–8, the carton 20C illustrated in FIG. 9 is very similar to the carton 20 illustrated in FIG. 1, and the similar parts have a corresponding designation except that a "C" is added to the end. The unique variation in FIG. 9 from the cartons 20, 20A or 20B of FIGS. 1, 4 and 8 respectively is the absence of a fitment 24 from the carton 20C. In this embodiment, the product inside the carton 20C is accessed through tearing open one of the top panels 34C–40C to form an integrated pouring spout. It is obvious that the non-fitment embodiment of FIG. 9 presents an even greater savings per carton due to the dual savings of material and lack of a fitment. However, the embodiment of FIG. 9 still has a tetrahedral top 22C.

Preferably, the top panels 34–40 (or any other series A–C) are equal in shape and area with adjacent panels 34–40 intersecting at a forty-five degree angle to a plane formed by corresponding adjacent side panels 26–32. However, other embodiments may have the top panels 34–40 of unequal area and shape. For example, if the carton 20 had a rectangular cross-section instead of the square cross-section of the 70 mm×70 mm carton 20, then top panels 34 and 38 would be of equal shape and area, and top panels 36 and 40 of equal shape and area. Thus, it is apparent that for purposes of the present invention, a tetrahedral top is defined as possibly having four top panels 34–40 unequal in shape and area.

There is illustrated in FIG. 10 a plan view of a preferred embodiment of a carton blank constructed in accordance with the teachings of the present invention. The carton blank 100 is fabricated into the carton 20 illustrated in FIG. 1. The blank 100 may be formed, filled and sealed on a packaging machine such as available from TETRA PAK, INCORPORATED of Chicago, Ill. The blank 100 is defined by a plurality of score lines which allow the blank 100 to be folded into the tetrahedral top carton 20 as illustrated in FIG. 1. A plurality of vertical score lines 102–108 will form edges 42–48 of the carton 20. The plurality of vertical score lines 102–108 will define the side panels 26–32 of the carton 20. The vertical score line 102 separates side panel 32 from a sealing panel 118. The sealing panel 118 is folded under side panel 30 during the initial forming of the carton 20.

The plurality of upper horizontal score lines 120–126 defines the plurality of top panels 34–40 from the plurality of side panels 26–32. An upper sealing horizontal score line 128 defines a top sealing panel 138 from the sealing panel 118. The plurality of lower horizontal score lines 174–180 defines the plurality of bottom panels 184–190 from the plurality of side panels 26–32. A lower sealing horizontal score line 182 defines a bottom sealing panel 192 from the sealing panel 1118. A bottom fin horizontal score line 194 defines the bottom fm 196. A plurality of lower diagonal score lines 198–204 assist in the folding of the bottom of the carton 20.

A plurality of upper diagonal score lines 140–154 define a plurality of top fins 158–172 from their respective top panels 34–40. In the carton 20 of FIG. 1, the top fins are folded inward and sealed to form the respective top diagonal edges 52–58. Each of the top panels 34–40 of the blank 100 have an arcuate edge 212–218 which form the cut-out 50 for placement of the fitment 24 therein for carton 20. Also on the edge of the blank 100, between adjacent top panels 34–40, a plurality of cut-outs 206–210 are each defined by a straight parallel edge transforming into angled edges on each end of the straight edge. Blank 100 is also utilized to form carton 20B of FIG. 8 with the outward folded fins 62–68. As described above, the fins 158–172 are folded outward and sealed together to form outward folded top fins 62–68

As set forth for the various embodiment of the cartons 20 and 20A–C, the various embodiments of blanks in FIGS. 11–13 are very similar to the blank 100 illustrated in FIG. 10, and the similar parts have a corresponding designation except that an "A", "B" or "C" respectively, is added to the end. In FIG. 11, which is the blank 100A for the carton 20A of FIGS. 4–7, the unique variations are the cut-out 50A for placement of the fitmnent 24 on a single top panel 34A, and the straight parallel edges 220–226 at the very top of the top panels 34A–40A. Each pair of the plurality of upper diagonal score lines 140A–154A on each of the top panels 34A–40A meet to form an apex at the center of each of the straight parallel edges 220–226. When the plurality of fins 158A–172A are folded inward, the apex 60 for carton 20A is formed from each of these apices.

Blank 100B of FIG. 12 has the straight parallel edges 220A–226A similar to FIG.11, however, the fitment 24 is disposed within the center as with the blank 100 of FIG. 10. This blank 100B has a square cut-out 50B, not shown, for placement of the fitment 24 therein.

FIG. 13 illustrates a blank 100C which may be utilized to form the carton 100C of FIG. 9. The Each pair of the plurality of upper diagonal score lines 140C–154C on each of the top panels 34C–40C meet to form an apex at the center of top perimeter of each of the top panels 34C–40C. When the plurality of fins 158C–172C are folded inward, the apex 60C for carton 20C is formed from each of these apices.

There is illustrated in FIG. 14 a blank 100D for formation of a tetrahedral top carton of the present invention on a mandrel where the tetrahedral top is the bottom of 39 the blank 100D. In this embodiment, the tetrahedral top is formed on a mandrel where the bottom of a typical gable top carton is formed. The blank 100D of this embodiment will have similar designations for similar parts except that a "D" is added to the end. However, the top panels 234–240 and bottom panels 284–290 of the blank 100D are different than the other blanks 100, 10A–C. The blank 100D when constructed would be similar to the carton 20 of FIGS. 1–3.

The tetrahedral top 22 is formed from top panels 234–240 on a mandrel similar to the forming of a bottom of a standard gable top carton. In this manner, a carton 20 20 formed from a blank 100D would be filled from the tetrahedral top and sealed on the bottom last. This reverse filling is accomplished on a slightly modified form, fill and seal packaging machine. The bottom of the carton 20 formed from blank 100D has an overfolded bottom which allows the tetrahedral top 22 to be sealed with a fitment 24 attached prior to filling. The overfolding improves the carton 20 durability and resistance to leaking. The plurality of bottom panels 284–290 are defined from the side panels 26D–32D by a plurality of lower horizontal score lines 174D–180D. A plurality of bottom fins 292–304 are defined from the plurality of bottom panels 284–290 by a plurality of lower fin horizontal score lines 306–318. The plurality of bottom fins provide for the overfolding bottom of a carton 20 constructed from blank 100D.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A blank for fabrication into a tetrahedral top carton, the blank comprising:

first, second, third and fourth side panels and a sealing panel, the side panels and the sealing panel separated from each other by a plurality of vertical score lines; and first, second, third and fourth top panels and a top sealing panel respectively adjacent the first, second, third and fourth side panels and the sealing panel, the top panels separated from each other by the plurality of vertical score lines, the top panels respectively separated from the side panels by a plurality of upper horizontal score lines, each of the first, second, third and fourth top panels being substantially identical and having a pair of miror image diagonal score lines defining a pair of top fins to allow for formation of a tetrahedral top structure composed of the first, second, third and fourth top panels, each of the first, second, third and fourth top panels having an arcuate edge wherein all of the arcuate edges are substantially identical, the arcuate edges forming a circular cutout of a carton formed from the blank, the first and second top panels having a first straight top edge at the intersection of the first and second top panels, the second and third top panels having a second straight top edge at the intersection of the second and third top panels, the third and fourth top panels having a third straight edge at the intersection of the third and fourth top panels.

2. A carton for the packaging of a flowable product, the carton formed from a blank, the carton comprising:

first, second, third and fourth side panels, the first side panel opposite the third side panel and the second side panel opposite the fourth side panel;

a tetrahedral top structure having first, second, third and fourth substantially identical top panels engaging the first, second, third and fourth side panels respectvely, each of the top panels slanted at an angle to their respective side panel, each of the top panels having a pair of mirror image fin panels and an arcuate top edge, each of the fin panels of each of the top panels intersecting and sealed to a fin panel of an adjacent top panel at a diagonal edge, the fin panels being folded inward of the carton, the arcuate edges of the top panels, when positioned adjacent one another, forming a circular cut-out in the center of the tetrahedral top structure; and a fitment disposed about the circular cut-out of the tetedral top structure.

* * * * *